US006384392B1

(12) United States Patent
Lee et al.

(10) Patent No.: US 6,384,392 B1
(45) Date of Patent: May 7, 2002

(54) MICROWAVE OVEN FOR UNIFORM HEATING

(75) Inventors: Young Min Lee; Yang Kyeong Kim, both of Incheon; Sung Jin Han, Seoul, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/756,845

(22) Filed: Jan. 10, 2001

(30) Foreign Application Priority Data

Aug. 23, 2000 (KR) ..... 00-49021

(51) Int. Cl.[7] ..... H05B 6/72
(52) U.S. Cl. ..... 219/756; 219/746; 219/748
(58) Field of Search ..... 219/756, 746, 219/748, 745

(56) References Cited

U.S. PATENT DOCUMENTS

| | | | | |
|---|---|---|---|---|
| 2,814,708 A | * | 11/1957 | Blass | 219/756 |
| 4,361,744 A | * | 11/1982 | Mercier et al. | 219/756 |
| 4,490,923 A | * | 1/1985 | Thomas | 219/756 |
| 5,948,310 A | * | 9/1999 | Shon et al. | 219/746 |
| 6,097,018 A | * | 8/2000 | Kim et al. | 219/746 |

FOREIGN PATENT DOCUMENTS

| | | | |
|---|---|---|---|
| JP | 62-128476 | * | 6/1987 |
| WO | WO 97/44988 | * | 11/1997 |
| WO | WO 98/35533 | * | 8/1998 |

* cited by examiner

*Primary Examiner*—Philip H. Leung
(74) *Attorney, Agent, or Firm*—Birch, Stewart, Kolasch & Birch, LLP

(57) ABSTRACT

A uniform heating structure for a microwave oven is provided. The structure of the invention includes: a magnetron for generating microwaves, a wave guide for guiding the microwaves generated by the magnetron, a pair of openings for radiating the microwaves guided by the wave guide in the form of circular polarized waves, and a cavity which is shaped in a polyhedron more than a rectangular and in which more than one interior walls constructing the polyhedron slope at a predetermined angle (θ1) excepting a right angle with respect to a neighboring interior wall. With this structure, the microwaves generated by the magnetron are reflected to be delivered to food through a sloping interior wall of the cavity while being radiated to the cavity through the wave guide and the openings, thus ensuring a uniform distribution of the microwaves throughout the food and making the food uniformly cooked.

3 Claims, 5 Drawing Sheets

MICROWAVE OVEN FOR UNIFORM HEATING

BACKGROUND OF THE INVENTION

1. Field of the Invention

The present invention relates to a microwave oven, and more particularly, to a uniform heating structure for a microwave oven which is capable of distributing microwaves generated by a magnetron more uniformly throughout the food being cooked in a cavity.

2. Description of the Background Art

Generally, a microwave oven is an apparatus for generating microwaves and cooking food by the microwaves.

Hereinafter, the structure and operation of a conventional microwave oven will be described.

As illustrated in FIG. 1, the microwave oven includes a casing(F) having a cavity 10 for cooking food therein at its center portion and an electric chamber 20 for generating microwaves at one side of the cavity 10, and a door 70 hingeably connected to one side of the casing(F) and opening and closing the cavity 10.

In detail, the cavity 10 includes a turntable 30 mounted on the bottom surface 11 of the cavity 10, and a turntable motor(not shown) for rotating the turntable 30.

And, as illustrated in FIG. 2, the electric chamber 20 includes a magnetron 40 for generating microwaves, a wave guide 50 for guiding the microwaves generated by the magnetron 40 to be radiated to the cavity 10, a pair of openings 60 for converting the microwaves radiated from the wave guide 50 into circular polarized waves, and a high voltage converter(not shown) for supplying power to the magnetron.

The cavity 10 of the conventional microwave oven is formed to have a rectangular space. The sections of the openings 60 and wave guide 50 protecting the openings 60 which are provided at one side wall 12 of the cavity 10 are formed in a square. The square sections of the wave guide 50 and openings 60 are disposed in the same horizontal and vertical direction as the one side wall of the cavity to which the wave guide 50 and openings 60 are connected.

Hereinafter, the operation of the microwave oven will be explained.

When a user places food on the turntable 30 of the cavity 10, and then applies power, the magnetron 40 generates microwaves, said microwaves being guided by the wave guide 50 to thus be radiated to the cavity 10 through the openings 60. The food is heated by the microwaves radiated to the cavity 10, and the turntable 30 is rotated by the turntable motor for uniform cooking performance.

Meanwhile, the essential point of cooking food by means of the microwave oven is how uniformly the microwaves generated by the magnetron are distributed to the food.

However, in the above-described rectangular-shaped structure for the cavity 10 of the conventional microwave oven, parts of the microwaves generated by the magnetron 40 are directly delivered to the food on the cavity 10 in the process in which the microwaves generated by the magnetron 40 are radiated to the cavity 10 through the wave guide 50 and the openings 60. In addition, most of the microwaves are randomly reflected to an interior wall of the rectangular-shaped cavity 10, thus causing an unpredictable distribution of the microwaves.

FIG. 3 is a view illustrating the distribution of microwaves generated in the cavity 10 of the conventional microwave oven. In FIG. 3, with respect to the strength of microwaves by colors, black indicates strong, gray indicates intermediate, and white indicates weak.

Therefore, the rectangular-shaped structure for the cavity 10 of the conventional microwave oven has a problem that 'uniform portions' and 'non-uniform portions' are formed while cooking food, which degrading the cooking performance of the microwave oven.

SUMMARY OF THE INVENTION

Accordingly, it is an object of the present invention to provide a uniform heating structure for a microwave oven which is capable of distributing microwaves generated by a magnetron more uniformly throughout the food being cooked in a cavity.

To achieve the above object, there is provided a uniform heating structure for a microwave oven according to the present invention, which includes: a magnetron for generating microwaves; a wave guide for guiding the microwaves generated by the magnetron; a pair of openings for radiating the microwaves guided by the wave guide in the form of circular polarized waves; and a cavity which is shaped in a polyhedron more than a rectangular and in which more than one interior walls constructing the polyhedron slope at a predetermined angle with respect to a neighboring interior wall.

Additional advantages, objects and features of the invention will become more apparent from the description which follows.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
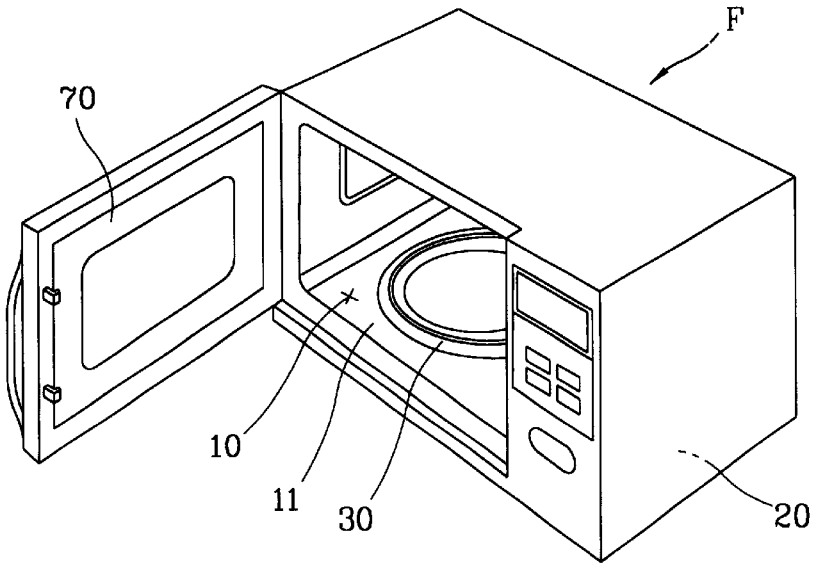
FIG. 1 CONVENTIONAL ART
FIG. 1 is a perspective view illustrating one example of a conventional microwave oven.
Figure 2:
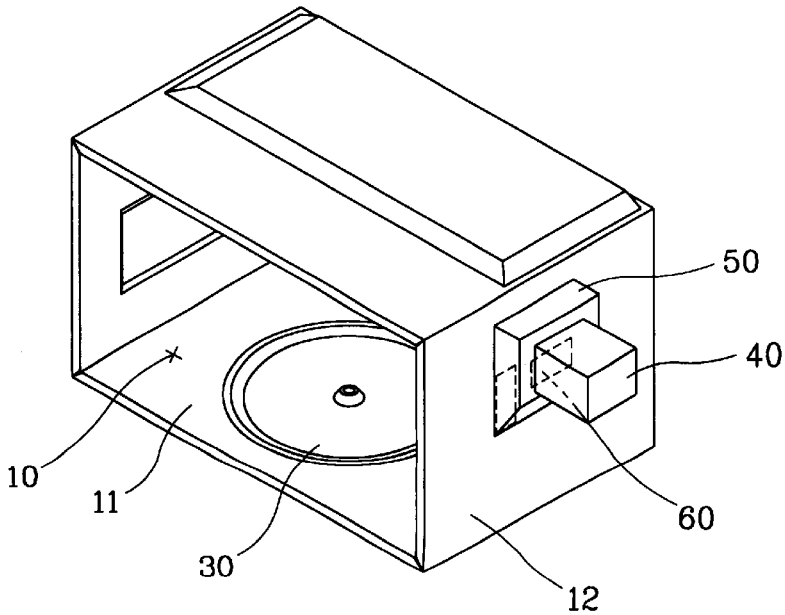
FIG. 2 CONVENTIONAL ART
FIG. 2 is a perspective view illustrating a cavity of the conventional microwave oven and a wave guide for guiding microwaves to the cavity.
Figure 3:
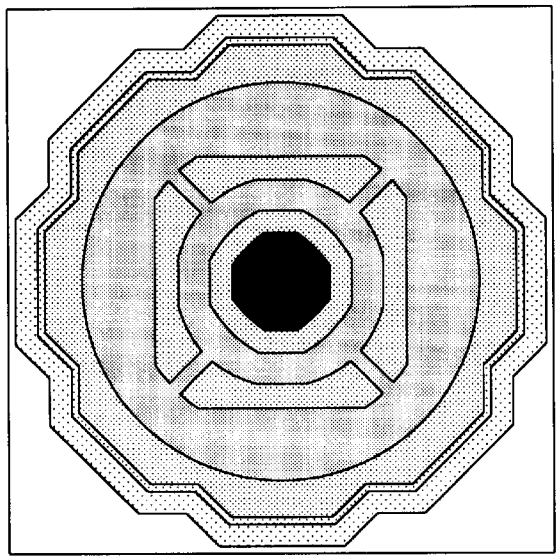
FIG. 3 CONVENTIONAL ART
FIG. 3 is a view illustrating the change in distribution of microwaves of the conventional microwave oven.

The preferred embodiments of the present invention will now be described with reference to the accompanying drawings. The same construction and operation as the conventional art are denoted by the same reference numeral, and the description thereof will be omitted.

Figure 4:
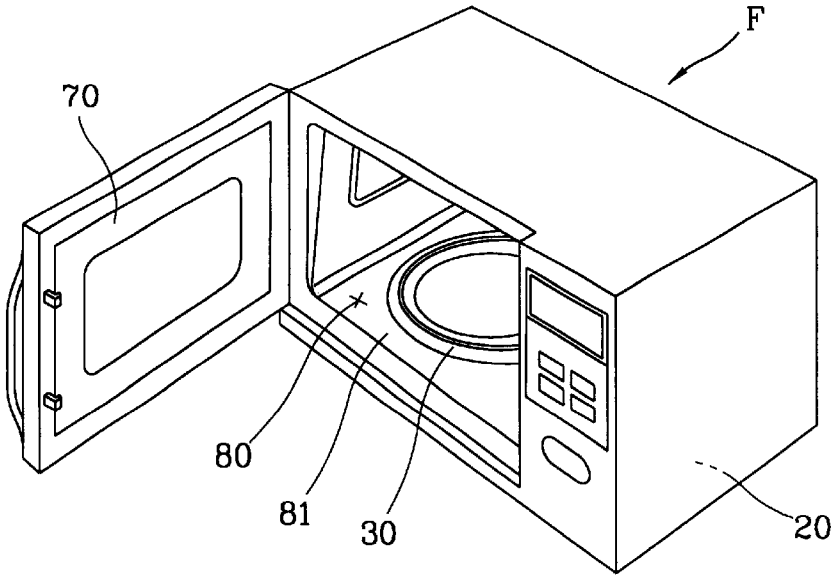
FIG. 4 is a perspective view illustrating a microwave oven having a uniform heating structure for a microwave oven according to the present invention.

As illustrated in FIG. 4, the microwave oven of the present invention includes: a casing(F) having a cavity 80 for cooking food at its center portion and an electric chamber 20 for generating microwaves at one side of the cavity 80, and a door 70 hingeably connected to one side of the casing(F) and opening and closing the cavity 80.

In detail, the cavity 80 includes a turntable 30 mounted on the bottom surface 81 of the cavity 80, and a turntable motor(not shown) for rotating the turntable 30.

Figure 5:
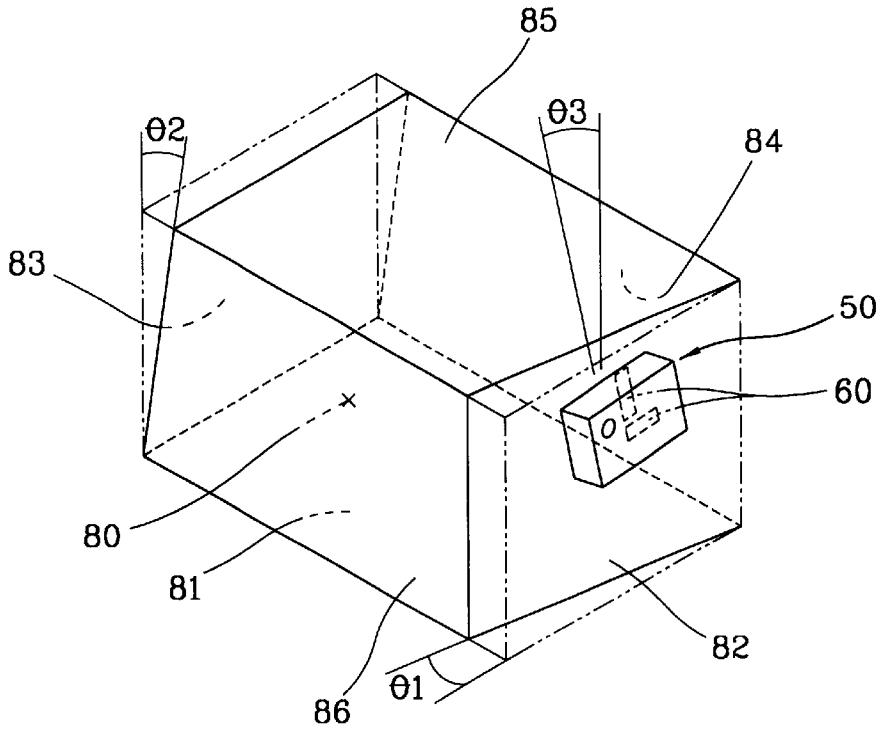
FIG. 5 is a perspective view illustrating the uniform heating structure for a microwave oven according to a first embodiment of the present invention.

And, as illustrated in FIG. 5, the electric chamber 20 includes a magnetron for generating microwaves, a wave guide 50 for guiding the microwaves generated by the magnetron 40 to be radiated to the cavity 10, a pair of openings 60 disposed inside the wave guide and converting the microwaves radiated from the wave guide 50 into circular polarized waves, and a high voltage converter(not shown) for supplying power to the magnetron.

An interior wall 82 on which the wave guide 50 and the pair of openings 60 are disposed slopes to the central direction in which food is placed at a predetermined angle ($\theta 1$) with respect to neighboring interior walls 84 and 86 of the cavity 80 at both sides of the interior wall 82.

And, the opposite interior wall 83 of the cavity also slopes to the central direction in which food is placed at a predetermined angle($\theta 2$) with respect to the interior wall 82 of the cavity having the wave guide 50 and the pair of openings 60.

The length of the interior wall 86 of the cavity 80, i.e., the door side, newly formed by the sloping of each wall surface is smaller than the length of the opposite interior wall 84.

In addition, the length of the interior wall 81 of the cavity 80 newly formed by the sloping of each wall surface is larger than the length of the opposite interior wall 85 of the cavity 80.

Figure 6:
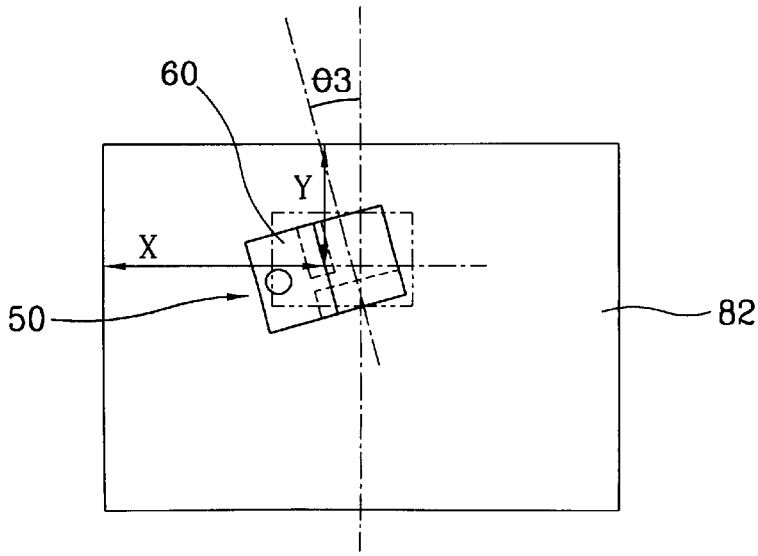
FIG. 6 is a front view illustrating a wave guide and openings constructing the uniform heating structure for a microwave oven according to the first embodiment of the present invention.

And, as illustrated in FIG. 6, the sections of the openings 60 and wave guide 50 protecting the openings 60 which are provided at one side wall 82 of the cavity 80 are formed in a square. The square sections of the wave guide 50 and openings 60 are connected in a state of being rotated at a predetermined angle($\theta 3$) so that they are not parallel to the horizontal and vertical surfaces of the cavity 80 to which the wave guide 50 and openings 60 are connected. In addition, the wave guide 50 and openings 60 can be disposed at a predetermined position(X,Y) in order to distribute microwaves more uniformly.

Figure 7:
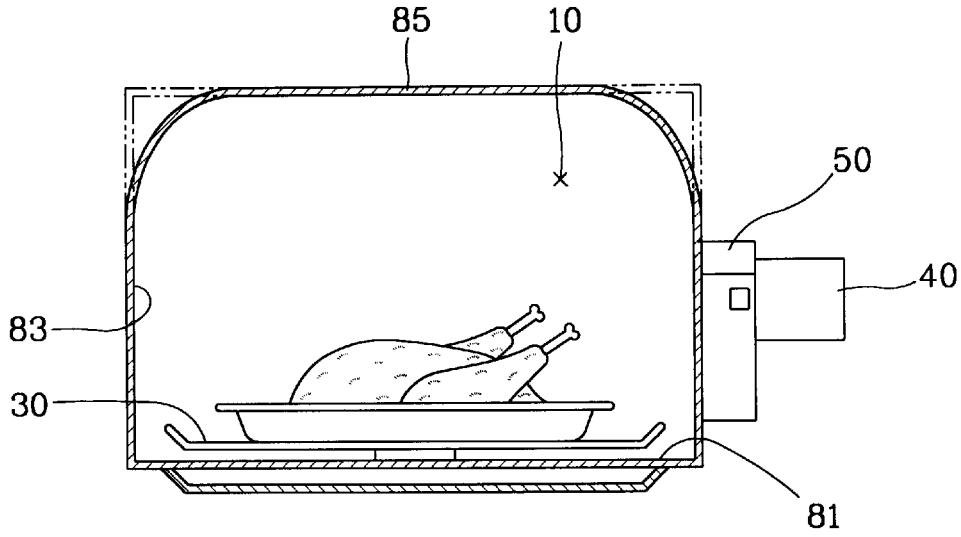
FIG. 7 is a cross-sectional view illustrating a uniform heating structure for a microwave oven according to a second embodiment of the present invention.

According to a second embodiment of the present invention, as illustrated in FIG. 7, the corner where one of the interior walls of the cavity 80 and the interior walls at both sides thereof join is curved.

In addition, according to a modification of the second embodiment, the corner where one of the interior walls of the cavity 80 and the interior walls at four sides thereof join is curved.

Figure 8:
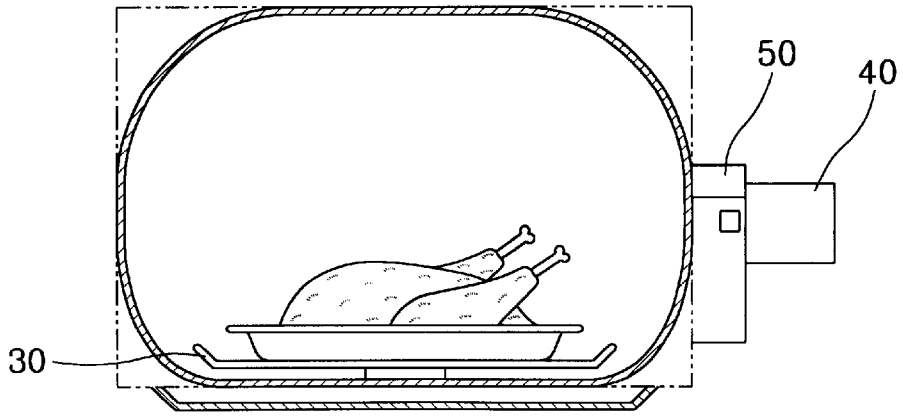
FIG. 8 is a cross-sectional view illustrating a uniform heating structure for a microwave oven according to a third embodiment of the present invention.

In addition, according to third embodiment of the present invention, as illustrated in FIG. 8, more than one of the interior walls of the cavity 80 are curved. These curved surfaces are preferably concave with respect to the central direction of the cavity 80.

Figure 9:
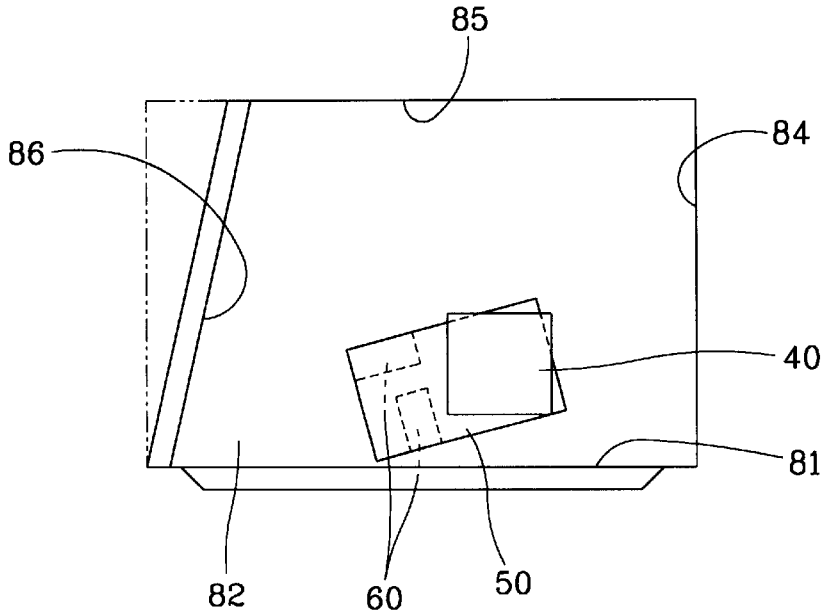
FIG. 9 is a cross-sectional view illustrating a uniform heating structure for a microwave oven according to a fourth embodiment of the present invention.

In addition, according to a fourth embodiment of the present invention, as illustrated in FIG. 9, among the interior walls of the cavity 80, the interior wall 86 on which the door is disposed slopes.

In addition, according to a fifth embodiment of the present invention, one or two of the interior surfaces of the cavity adjacent to both sides of the interior wall 82 of the cavity 80 at which the wave guide 50 and the openings 60 are disposed can slope.

In addition, only one half or one third of the above one or two interior walls of the cavity 80 can slope to the central direction in which food is placed at a predetermined angle with respect to any one interior wall of the cavity 80.

In addition, the above one or two interior walls of the cavity 80 can slope to the reverse of the center direction in which food is placed at a predetermined angle.

Hereinafter, the operation and effects of the uniform heating structure for a microwave oven according to the present invention will be described as follows.

When a power is applied to the microwave oven, the magnetron 40 generates microwaves, said microwaves being guided by the wave guide 50 to thus be radiated into the cavity 80 through the openings 60.

In this process, the microwaves radiated into the cavity 80 through the wave guide 50 and openings 60 are reflected to the sloping interior walls of the cavity to be distributed throughout food. However, this reflection is conducted more uniformly because of the structure of the cavity 80 of the invention which constructs, not a simple rectangular structure of the conventional cavity 10, but a more complex polyhedron structure, and by increasing factors for controlling the distribution of microwaves in the cavity.

Figure 10:
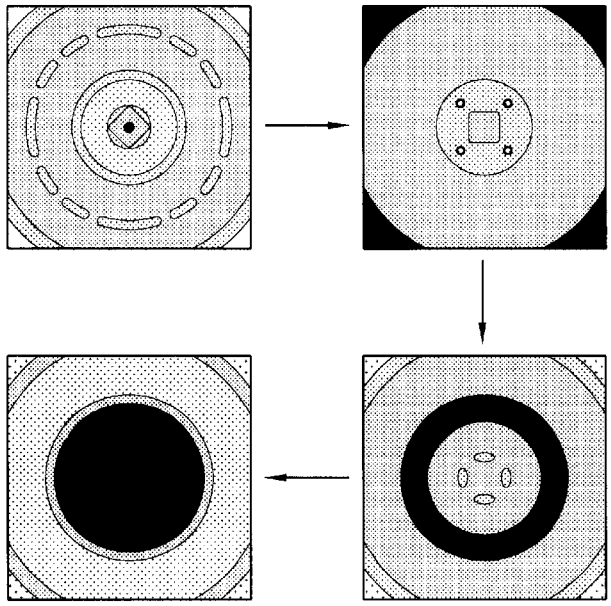
FIG. 10 is a view illustrating the change in distribution of microwaves based on the control of each factor of the uniform heating structure for the microwave oven according to the present invention.

As the result, FIG. 10 explains the following.

FIG. 10 is a view illustrating the average value of the sum of vertically and horizontally polarized waves of microwaves based on the center of the cavity, which illustrates the change in the average value when the position of the wave guide 50 is changed, and the changes in the resultant average value by adding a factor of $\theta 1$, $\theta 2$, and $\theta 3$, sequentially .

In FIG. 10, with the respect to the strength of microwaves by colors, black indicates strong, gray indicates intermediate, and white indicates weak. Generally, it is known that the distribution of microwaves having a large strength at the central portion and being widely and uniformly distributed is preferable.

Accordingly, the distribution in the last case where all factors are applied is most uniformly performed.

As described above, in the uniform heating structure for a microwave oven according to the present invention, the interior wall on which the food is placed slopes to the direction in which food is placed, and the wave guide for guiding microwaves to the cavity and the openings are disposed in a state of being rotated at an angle. Thus, microwaves to be radiated to the cavity through the wave guide and openings are uniformly distributed, and accordingly the food is uniformly cooked, thereby increasing the cooking performance and reliability of the microwave oven.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A microwave oven for uniform heating comprising:

a magnetron for generating microwaves;

a wave guide for guiding the microwaves generated by the magnetron;

a pair of openings for radiating the microwaves guided by the wave guide in the form of circular polarized waves; and a cavity having the configuration of a polyhedron and in which two or more interior walls of which the polyhedron is comprised slope at a non-right angle with respect to an adjacent interior wall, wherein an interior surface of the interior wall of the cavity opposite to that on which the wave guide and openings are installed slopes in a direction in which food is placed, and said pair of openings being formed on the surface of a sloping interior wall of the cavity.

2. The microwave oven according to claim 1, wherein said wave guide and said openings are set at an angle to the horizontal on an interior wall.

3. The microwave oven according to claim 1, wherein one half to one third of said interior walls slope in the direction in which food is placed.

* * * * *